US008967097B2

(12) United States Patent
Perez et al.

(10) Patent No.: US 8,967,097 B2
(45) Date of Patent: Mar. 3, 2015

(54) VARIABLE STROKE MECHANISM FOR INTERNAL COMBUSTION ENGINE

(75) Inventors: Luis Marino Gonzalez Perez, Cúa (VE); Simon Alfredo Perez Perez, Caracas (VE); Henrique Jose Perez Perez, Caracas (VE)

(73) Assignee: Lugo Developments, Inc., Caracas (VE)

( * ) Notice: Subject to any disclaimer, the term of this patent is extended or adjusted under 35 U.S.C. 154(b) by 329 days.

(21) Appl. No.: 13/109,505

(22) Filed: May 17, 2011

(65) Prior Publication Data

US 2012/0291755 A1 Nov. 22, 2012

(51) Int. Cl.
*F02D 15/02* (2006.01)

(52) U.S. Cl.
USPC ..... 123/48 B; 123/48 A; 123/48 C; 123/48 R; 123/197.3; 123/197.4; 123/202; 123/78 E; 123/78 F

(58) Field of Classification Search
USPC .... 123/48 B, 48 A, 48 C, 48 R, 197.3, 197.4, 123/311, 48 D, 78 E, 78 F, 78 R, 90.15, 202
See application file for complete search history.

(56) References Cited

U.S. PATENT DOCUMENTS

| | | | | |
|---|---|---|---|---|
| 1,278,563 | A | | 9/1918 | Austin |
| 1,326,129 | A | | 12/1919 | Chadbourne |
| 1,326,733 | A | | 12/1919 | Hulse |
| 1,553,009 | A | | 9/1925 | Stuke |
| 1,786,423 | A | | 12/1930 | Cady |
| 1,964,096 | A | | 6/1934 | Tucker |
| 2,394,269 | A | | 2/1946 | Svete |
| 3,686,972 | A | | 8/1972 | McWhorter |
| 3,861,239 | A | | 1/1975 | McWhorter |
| 4,044,629 | A | | 8/1977 | Clarke |
| 4,152,955 | A | | 5/1979 | McWhorter |
| 4,966,043 | A | | 10/1990 | Frey |
| 5,040,502 | A | | 8/1991 | Lassiter |
| 5,060,603 | A | | 10/1991 | Williams |
| 5,158,047 | A | * | 10/1992 | Schaal et al. ..... 123/78 BA |
| 5,165,368 | A | | 11/1992 | Schechter |
| 5,170,757 | A | | 12/1992 | Gamache |
| 5,465,648 | A | | 11/1995 | Cy |

(Continued)

OTHER PUBLICATIONS

Gomecsys, "The GoEngine mechanism" ; Gomecsys, www.gomecsys.com/uk/, Apr. 4, 2011, 13 pages.

(Continued)

*Primary Examiner* — Hung Q Nguyen
*Assistant Examiner* — Ruben Picon-Feliciano
(74) *Attorney, Agent, or Firm* — Nelson Mullins Riley & Scarborough LLP

(57) ABSTRACT

A mechanism for varying the stroke length of an internal combustion engine during each cycle of operation includes a gear set with a first gear non-rotatably mounted to the engine block and a second gear having teeth formed on an inner surface thereof meshing with the first gear to achieve a uniform mechanical crank arm and a variable cam arm for producing a varying length of piston reciprocation throughout the overall stroke cycle of the engine. The orientation of the crank arm and the cam arm relative to the axis of piston reciprocation is selected for causing the crank arm and the cam arm to cooperatively produce a positive torque on the crankshaft at the top dead center position of the piston. The gear set is also selectively configured and dimensioned to achieve a predetermined ratio of the length of the cam arm to the length of the crank arm.

1 Claim, 13 Drawing Sheets

(56) References Cited

U.S. PATENT DOCUMENTS

| | | | | |
|---|---|---|---|---|
| 5,908,014 | A | 6/1999 | Leithinger | |
| 5,927,236 | A * | 7/1999 | Gonzalez | 123/78 F |
| 6,349,684 | B1 | 2/2002 | De Gooijer | |
| 6,408,814 | B2 | 6/2002 | Shigemori | |
| 6,564,762 | B2 | 5/2003 | Dow | |
| 6,796,285 | B2 | 9/2004 | Karnes | |
| 7,036,474 | B2 * | 5/2006 | Axmacher et al. | 123/90.31 |
| 7,293,542 | B2 | 11/2007 | Ozdamar | |

OTHER PUBLICATIONS

PCT International Search Report for PCT/IB12/01882.

* cited by examiner

| cam to crank ratio | crank arm mm | cam arm mm | crank angle TDC | initial arm mm TDC | arm at 16° ATDC | admission cc | expansion cc | spark ignition | | compression ignition | |
|---|---|---|---|---|---|---|---|---|---|---|---|
| | | | | | | | | compression ratio | expansion ratio | compression ratio | expansion ratio |
| 20% | 22,77 | 4,55 | 6,4° | 2,57 | 9,26 | 1000 | 1222 | 10:1 | 12,0:1 | 15:1 | 18,1:1 |
| 30% | 24,02 | 7,21 | 9,0° | 3,85 | 10,94 | 1000 | 1351 | 10:1 | 13,2:1 | 15:1 | 19,9:1 |
| 40% | 25,38 | 10,15 | 11,5° | 5,27 | 13,22 | 1000 | 1494 | 10:1 | 14,5:1 | 15:1 | 21,9:1 |
| 50% | 26,56 | 13,28 | 13,9° | 6,76 | 15,13 | 1000 | 1636 | 10:1 | 15,7:1 | 15:1 | 23,9:1 |
| 60% | 26,59 | 15,95 | 16,1° | 8,01 | 16,88 | 1000 | 1710 | 10:1 | 16,4:1 | 15:1 | 24,9;1 |
| 70% | 25,89 | 18,12 | 18,2° | 9,00 | 17,67 | 1000 | 1739 | 10:1 | 16,7:1 | 15:1 | 25,3:1 |
| 80% | 24,84 | 19,87 | 20,9° | 10,21 | 19,00 | 1000 | 1740 | 10:1 | 16,7:1 | 15:1 | 25,3:1 |
| 90% | 23,65 | 22,42 | 22,5° | 10,79 | 19,62 | 1000 | 1726 | 10:1 | 16,3:1 | 15:1 | 25,1:1 |
| 100% | 22,42 | 22,42 | 24,0° | 11,24 | 20,05 | 1000 | 1704 | 10:1 | 16,3:1 | 15:1 | 24,8:1 |

Fig. 13

VARIABLE STROKE MECHANISM FOR INTERNAL COMBUSTION ENGINE

BACKGROUND OF THE INVENTION

The present invention relates broadly to internal combustion engines and, more particularly, to so-called "variable stroke" engines wherein a mechanical connecting arrangement between reciprocating pistons and an engine crankshaft varies the extent of piston movement during the overall operational cycle of the engine. Generally, such mechanisms have the purpose of increasing the efficiency of internal combustion engines by achieving an effectively larger mechanical crank arm during the expansion stroke and an effectively shorter mechanical crank arm during the intake stroke.

Conventional internal combustion engines operate according to a repeating sequence of movements typically referred to as an intake stroke, a compression stroke, an expansion stroke, and an exhaust stroke. In this sense, "stroke" describes the reciprocating movements of a drive piston as it travels back and forth through a cylindrical combustion chamber in an engine housing or "block." The term "cycle" may also sometimes be used interchangeably with the term "stroke." Hence, an engine operating according to the above-described manner is commonly referred to as a four-cycle or four-stroke engine, indicating that to complete a full power cycle the piston must reciprocate four times in the cylinder. "Cycle" is also used to describe the complete power cycle of the engine. This usage of terminology is consistent within and well understood to those skilled in the art.

As indicated, various designs have been advanced to cause an engine piston to travel a longer or shorter distance during the intake, compression, expansion, or exhaust strokes or during any combination of them, and to modify the piston velocity in some portion of its travel. For example, the so-called top or bottom dead center position of the piston has been shifted up or down for every revolution or every two revolutions. All of these conditions are different versions of a variable stroke engine. Chadbourne U.S. Pat. No. 1,326,129 and Clarke U.S. Pat. No. 4,044,629 describe an extended expansion stroke. A practical application of an extended expansion stroke is the Millenia model automobile manufactured by Mazda, which utilizes a so-called Miller-cycle engine of the type designed in 1947 by U.S. engineer Ralph Miller. Miller's engines have been used for some time in ships and stationary power plants. The engineering goal is to reduce the engine's compression ratio without interfering with the power generating expansion stroke. In the Miller-cycle engine, the piston rises one-fifth of its stroke before the air intake valve is closed. After combustion occurs at the top of the stroke, the expanding gases push the piston all the way down to the bottom of the stroke, so the expansion ratio is not affected.

During the first half of the twentieth century, it was generally accepted among persons skilled in the art of internal combustion engines that the combustion products inside an engine cylinder had to be removed as completely as possible during the exhaust stoke following each expansion stoke and preceding the suceeding intake stroke. Many different patents propose differing ways to obtain a larger exhaust stroke. See, e.g., Hulse U.S. Pat. No. 1,326,733; Svete U.S. Pat. No. 2,394,269; Cady U.S. Pat. No. 1,786,423; Tucker U.S. Pat. No. 1,964,096; and Austin U.S. Pat. No. 1,278,563. Chadbourne U.S. Pat. No. 1,326,129 and Clarke U.S. Pat. No. 4,044,629 also refer to a larger exhaust and expansion stroke. However, due to emission regulations implemented in the latter part of the twentieth century, new engine designs have been advanced wherein a portion of exhaust gas is recirculated or retained in the combustion chambers as a means of reducing the atmospheric emission of NOx (oxides of nitrogen) caused by the oxidation of nitrogen in the combustion chamber. This is accomplished by allowing intake manifold vacuum to draw exhaust gas into the intake manifold through an EGR (exhaust gas recirculation) valve.

Others have used variable stroke designs to modify the engine compression ratio. A lot of work has been done, especially in Europe and Japan, to achieve a so-called variable compression ratio by means of an arrangement that varies the position of the piston relative to the head of the cylinder.

The compression ratio is the ratio between capacity of the cylinder and capacity of the combustion chamber; in other words, the air-fuel mixture that goes into the cylinder during the intake stroke is then compressed as many times as the compression ratio value. Generally, the higher the compression ratio, the higher the engine efficiency. Some limitations such as mixture pre-ignition, knocking, engine temperature, and even engine construction exist. Since the compression ratio is one of the main factors affecting the engine efficiency, it is desirable to optimize it for different operating conditions (speed rate, load, acceleration, etc.). Schechter U.S. Pat. No. 5,165,368 describes a representative example of such an engine A variable piston stroke application has also been utilized to optimize the pressure acting on the piston. For this purpose, the piston speed is decreased, relative to the speed of a conventional piston, near the top dead center to maximize the combustion process and the resulting forces acting on the piston. Schaal et al U.S. Pat. No. 5,158,047, Williams U.S. Pat. No. 5,060,603, and McWhorter U.S. Pat. Nos. 3,686,972; 3,861,239; and 4,152,955 are representative of this concept.

More recently, U.S. Pat. No. 5,927,236, discloses an internal combustion engine design wherein a gear set arrangement is utilized to connect the crankshaft and the piston connecting rods of the engine via offset bearing surfaces to accomplish a variation of the length of piston stroke over a complete engine power cycle. In particular this design seeks to increase the piston stroke via an increased effective crank arm length during the expansion portion of the power cycle to increase the torque output, and to reduce the stroke and piston velocity during the intake or admission and exhaust portions of the cycle to increase volumetric efficiency, all thereby enhancing the thermoefficiency of the engine.

SUMMARY OF THE INVENTION

It is fundamentally an object of the present invention to further advance the invention of U.S. Pat. No. 5,927,236 described above.

More particularly, it is an object of the present invention to achieve further enhancements in torque output, horsepower output, fuel efficiency, volumetric efficiency, and emissions reduction in internal combustion engines utilizing improvements in the variable stroke mechanism of the design of U.S. Pat. No. 5,927,236.

Toward those ends, the present invention provides an improved internal combustion engine operable according to a four stroke cycle wherein the piston reciprocates within the combustion chamber through an intake stroke moving in a first direction, a compression stroke moving in a second direction, an expansion stroke moving in the first direction, and an exhaust stroke moving in the second direction. The position of the piston at the conclusion of the compression stroke and at the beginning of the expansion stroke is defined as top dead center. Basically, the engine of the present invention comprises an engine block defining at least one combustion chamber, a crankshaft rotatably mounted to the engine block, a piston disposed within the combustion chamber for reciprocation along a chamber axis, and a connecting rod pivotably mounted to the piston.

According to the present invention, a mechanism for producing a variable stroke length in an internal combustion engine utilizes a mechanical gearing assembly to connect the connecting rod rotatably to the crankshaft for translating the reciprocating motion of the piston into rotational motion of the crankshaft. Basically, the mechanical assembly comprises a gear set including at least a first gear member non-rotatably mounted to the engine block and a second gear member meshingly engaged with the first gear member. The second gear member has a first bearing surface to which the connecting rod is mounted and a second bearing surface mounted to the crankshaft for rotation of the second gear member with the crankshaft. The second bearing surface is offset from the crankshaft axis to move in a circular path about the crankshaft axis for imposing a uniform mechanical crank arm on the crankshaft throughout the four stroke cycle of the engine. The first and second bearing surfaces are spaced from one another by an offset distance causing the first bearing surface to move alternatingly in inner and outer elliptical paths about the crankshaft for imposing a variable cam arm on the crankshaft. Thus, the sum of the crank arm and the cam arm cause the length of the piston reciprocation to vary throughout the four stroke cycle of the engine.

In accordance with one aspect of the present invention, the inner and outer elliptical paths of the first bearing surface intersect at a point at or closely adjacent to the combustion chamber axis for causing the crank arm and the cam arm to cooperatively produce a positive torque on the crankshaft at the top dead center position of the piston. For example, in one embodiment of the invention, the inner and outer elliptical paths of the first bearing surface intersect at a point coinciding with the combustion chamber axis. Alternatively, the inner and outer elliptical paths of the first bearing surface may intersect at a point spaced a predetermined number of degrees, preferably less than or equal to approximately twenty-five degrees (25°), in advance of the combustion chamber axis in the direction of rotation of the crankshaft, for causing the position of the piston at the conclusion of the exhaust stroke and at the beginning of the intake stroke to be at a predetermined spacing below the top dead center position, thus permitting the combustion chamber to retain a predetermined volume of exhaust when beginning the subsequent intake stroke.

According to another aspect of the present invention, the first and second bearing surfaces of the second gear member are selectively configured and dimensioned to achieve a predetermined ratio of the length of the cam arm to the length of the crank arm. Preferably, the cam arm length is at least approximately 20% of the crank arm length and may be up to approximately 100% of the crank arm length.

According to a related aspect of the present invention, the ratio of the length of the cam arm to the length of the crank arm is selected to achieve a predetermined volumetric capacity in the combustion chamber at the conclusion of the intake stroke.

The first gear member may preferably be a pinion gear and the second gear member may preferably include a crown gear portion having gear teeth formed about a radially inward surface of an annular body to mesh with the pinion gear to move thereabout in the manner of a planetary gear. The second gear member also preferably includes a bearing portion which projects outwardly from the crown gear portion and has the first bearing surface formed on an outer surface of the bearing portion and the second bearing surface formed on an inner surface of the bearing portion. In this manner, the connecting rod may rotate on the first bearing surface and the second bearing surface may rotate on the crankshaft.

The present invention is adaptable to substantially any internal combustion engine, and may preferably be incorporated in a multi-cylinder engine having a plurality of combustion chambers and a plurality of gear sets corresponding in number to less than or equal to the number of combustion chambers.

BRIEF DESCRIPTION OF THE DRAWINGS

FIG. 13 is a chart compiling comparative data for differing selective variations in the ratio of the length of the cam arm to the length of the crank arm in an embodiment of the present invention.

DETAILED DESCRIPTION OF THE PREFERRED EMBODIMENTS

Figure 1:
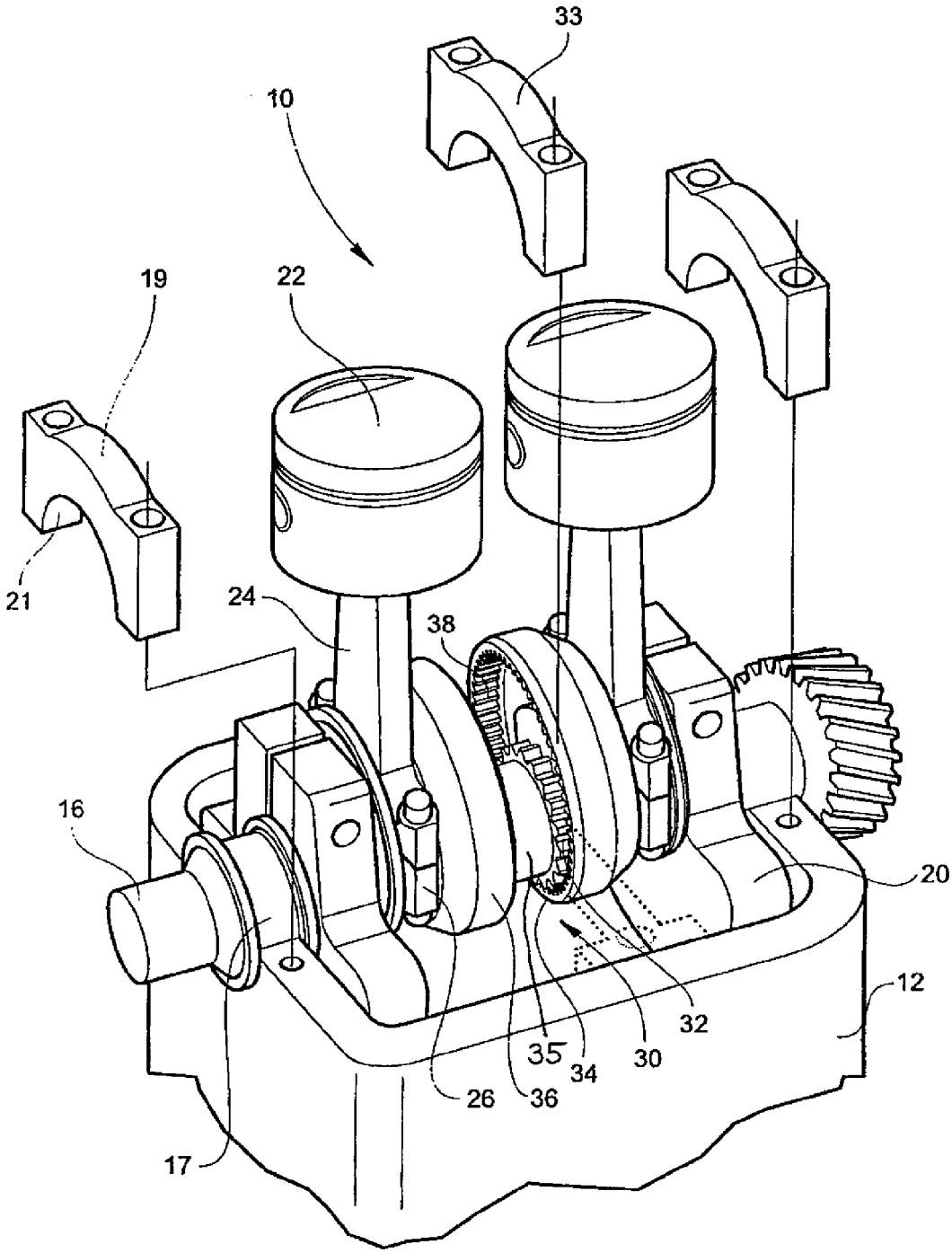
FIG. 1 is a perspective view of an improved internal combustion engine equipped with a mechanical assembly for producing a variable length of piston stroke according to a preferred embodiment of the present invention.

Turning now to the accompanying drawings and, initially to FIGS. 1-4, an improved internal combustion engine according to a preferred embodiment of the present invention is illustrated generally at 10 and includes a conventional engine block 12. It should be noted that the engine block 12 is only shown partially and diagrammatically as a support for the mechanical assembly according to the present invention. Further, for illustrative purposes, the engine is shown only as a two-cylinder engine. Nevertheless, it will be readily appreciated by those skilled in the art that the mechanism of the present invention may be adapted in varied configurations for virtually any multi-cylinder engine.

A generally conventional crankshaft 16 is provided with a crankshaft bearing surface 17 at the junction of the crankshaft 16 and the engine block 12. A bearing cap 19, formed as a form fitting archway having two bolt openings formed therein and a curved bearing surface 21 formed as an underside thereof, is mounted to the engine block 12 with preformed openings in the engine block and the bearing cap 19 in registry to accept conventional bolts to affix the bearing cap 19 to the engine block 12 to retain the crankshaft 16 in place.

The engine block is formed with two cylindrical bores 14 (FIGS. 3 and 4) within which two conventional pistons 22 are disposed for reciprocating movement. Two identical conventional connecting rods 24 are mounted pivotably to the pistons 22 and are in turn mounted to the crankshaft 16 via the mechanical assembly of the present invention in a manner described in greater detail hereinafter. Conventional end caps 26 are attached to the connecting rods 24 to retain them in a rotatable manner in association with the crankshaft 16. As will be seen in greater detail hereinafter, the connecting rods 24 are not mounted directly to the crankshaft 16 but are mounted to a bearing surface of the mechanism of the present invention.

The mechanical assembly of the present invention comprises a gear set 30 mounted to the crankshaft 16 in association with each piston and connecting rod assembly such that the gear sets 30 form the primary driving portion of the present invention. Each gear set 30 includes a first gear member 32, preferably in the form of a pinion gear, in operational meshing engagement with a second gear member 36, preferably in the form of a crown gear. Eccentric counterweights 20 are mounted to the crankshaft for balancing, as would be commonplace in a two cylinder engine. The gear sets 30 are configured as mirror images of one another that essentially divide the engine 10 into two minor-imaged halves, with the gear sets 30 in the center.

Figure 2:
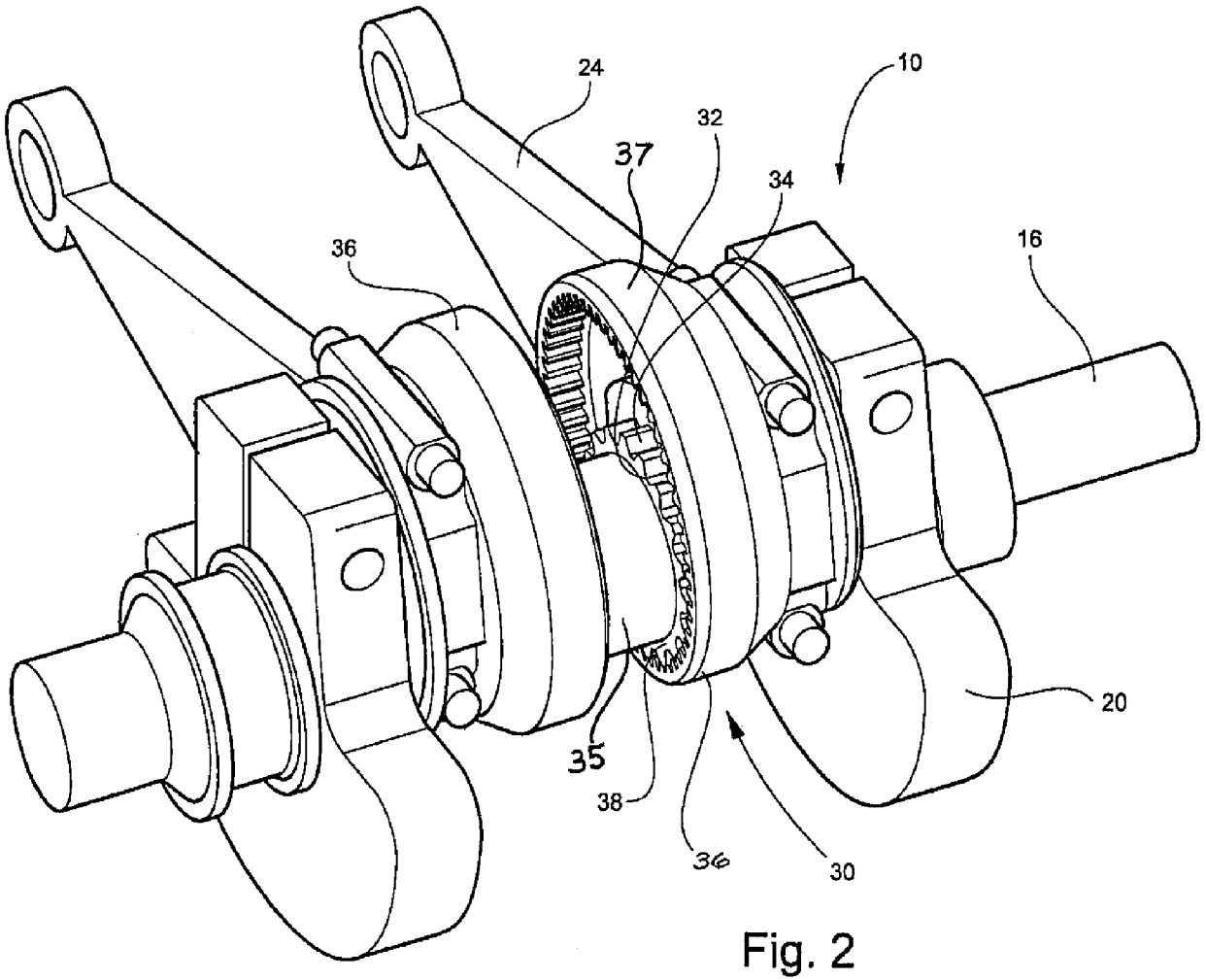
FIG. 2 is a perspective view of the variable stroke mechanism according to the embodiment of FIG. 1.

With reference to FIG. 2, the first gear member 32 is illustrated in the preferred form of a pinion gear having a cylindrical body with a row of teeth 34 formed circumferentially thereabout. The second gear member 36 is illustrated in the preferred form of a crown gear having a cup-like generally cylindrical gear body 37 with a continuous array of teeth 38 formed around a radially inward annular surface thereof. The two first gear members 32 are separated by and mounted to a cylindrical support member 35 which is fixed to the engine block by a clamping member 33 as seen in FIG. 1. Each first gear member 32 is thereby fixed in position within the engine block against rotation. The teeth of the second gear member 36 are meshingly engaged with the teeth of the first gear member 32 for rotation of the second gear member 36 about the first gear member 32 in a planetary manner.

Figure 3:
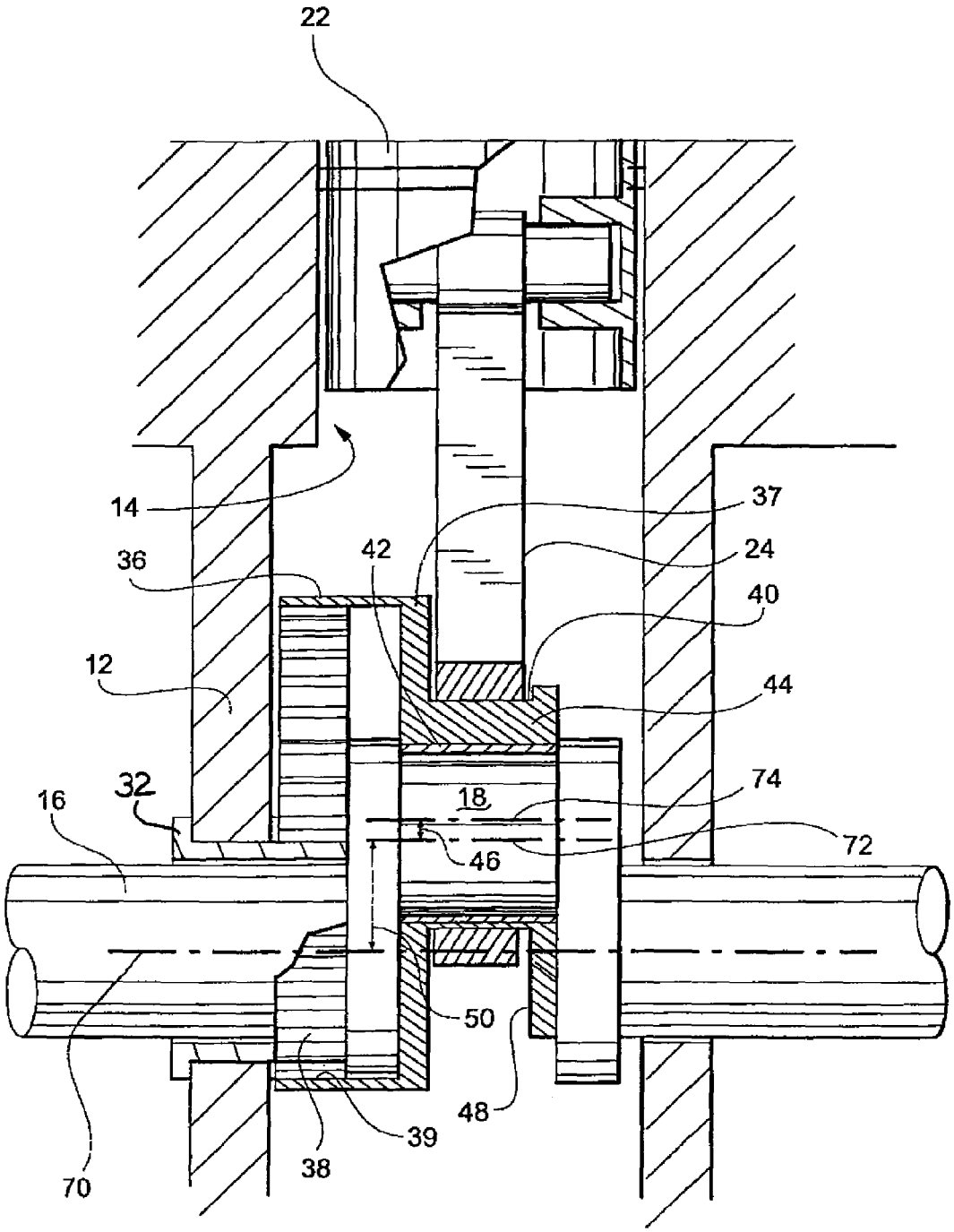
FIG. 3 is a cutaway diagrammatic sectional view of the internal combustion engine and variable stroke mechanism of FIGS. 1 and 2.
Figure 4:
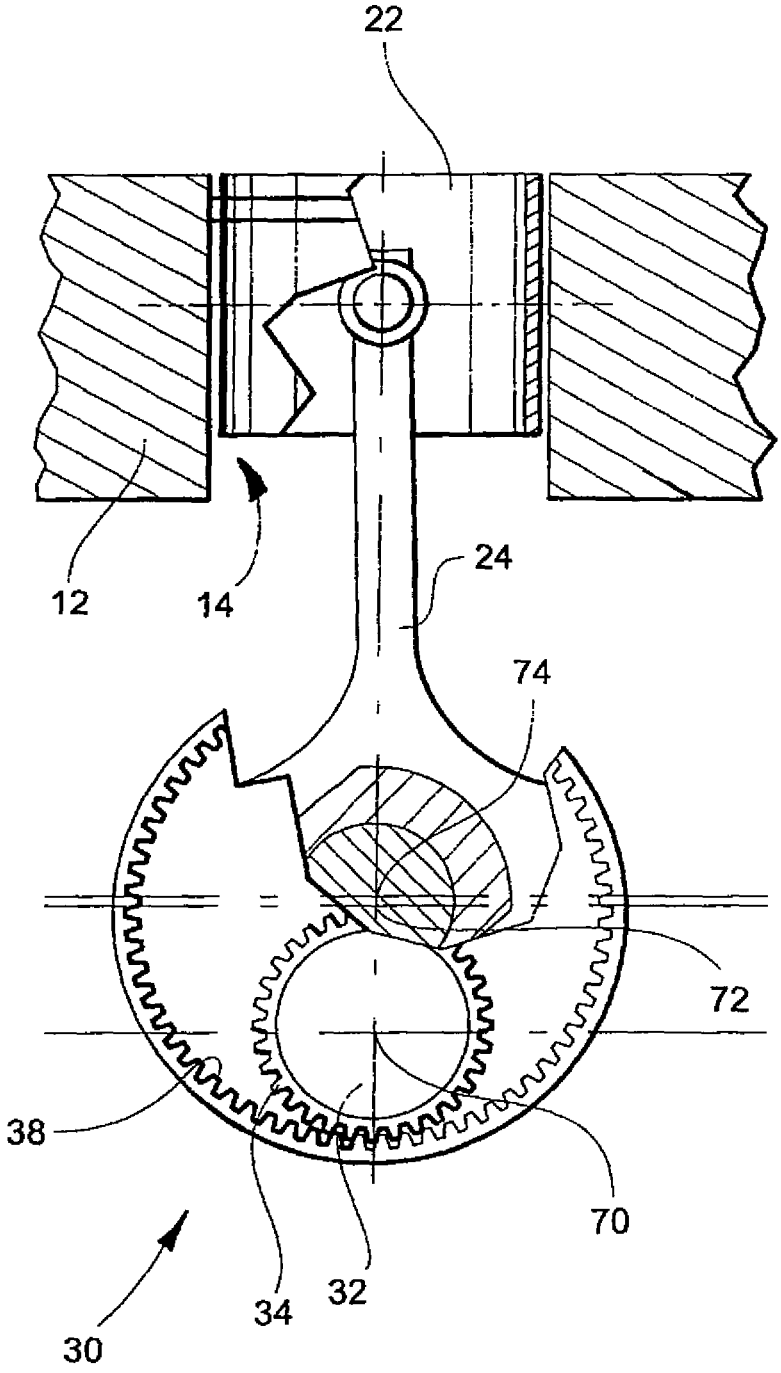
FIG. 4 is a second cutaway view of the variable stroke mechanism illustrated in FIG. 3.

Turning now to FIGS. 3 and 4, a more diagrammatic representation of the mechanism according to the present invention is provided. Hereagain, the engine block is illustrated only partially and schematically, as indicated generally at 12, to depict one cylinder 14 through which a piston 22 moves.

The second gear member 36 includes a bearing member 48 in the form of an annular hub projecting in an axial direction outwardly from the exterior side of the cup-like gear body 37 opposite and linearly displaced from the interior gear teeth 38. The bearing member 48 has a first outer annular bearing surface 40 formed circumferentially around the exterior surface thereof about which the connecting rod 24 is rotationally mounted, and a second inner bearing surface 42 formed about the radially inward surface of the bearing member 48. The inner bearing surface 42 is cylindrical about a common central axis with the cup-like cylindrical gear body 37. The outer bearing surface 40 is also cylindrical but is eccentric with respect to the axis of the inner bearing surface 42 and the gear body 37, whereby the body of the bearing member 48 has a radially enlarged offset portion 44 between the bearing surfaces 40, 42 which defines a maximum offset distance 46 explained in greater detail hereinafter. The bearing member 48 defining the bearing surfaces 40, 42 may be formed integrally with the gear member 36, but this is not a specific requirement. The only requirement is that the bearing member 48 must rotate unitarily with the gear member 36 and integral formation is the simplest way to achieve this result.

As will thus be understood with reference to FIGS. 3 and 4, three rotational axes are thereby defined by the present mechanical assembly. The crankshaft 16 rotates about a crankshaft axis 70 which, as seen in FIGS. 3 and 4, is coincident with the geometric axis of the first gear member 32, i.e., the axis about which the gear member 32 would rotate if its mounting to the engine block permitted free rotation. The disposition of the first gear member 32 is adjustable to permit a few degrees of rotational adjustment about the crankshaft axis 70. The second gear member 36, including its integral bearing member 48, rotates about an axis 72 which is parallel to but offset from the crankshaft axis 70 by a predetermined offset distance 50. This crankshaft offset 50 is present in every crank-driven internal combustion engine and produces a non-varying mechanical crank arm acting on the crankshaft 16 through which the pumping reciprocation of the piston is translated into rotation of the crankshaft 16. Due to the eccentric orientation of the bearing surface 40, the connecting rod 24 rotates about a separate axis 74 which also extends parallel to the crankshaft axis 70 and the offset axis 72. The distance between the offset axis 72 and the connecting rod axis 74 defines a maximum offset distance 46 which imposes a variable cam arm acting on the crankshaft 16. In this manner, the maximum offset distance 46 combines with the crankshaft offset 50 to define a total effective crank length which, as will be explained in greater detail hereinafter, varies according to the varying cam arm throughout the engine operational cycle.

Those skilled in the art will appreciate that the engine has not been described as having any valve system, cooling system, ignition system, and the accompanying structural components to provide a fully operational internal combustion engine. The engine will necessarily include these systems and components, but such systems and components do not need to differ from the conventional components and systems in a standard internal combustion engine. Hence, such components are beyond the scope of and unnecessary to a description and understanding of the present invention, and are therefore omitted so that the present invention may be described with greater clarity. Any suitable valving system, cooling system, ignition system, and associated structural components will operate satisfactorily with the present invention and it should be noted that the present invention is adaptable to virtually any standard crank-driven internal combustion engines.

As in conventional internal combustion engines, detonation of an air fuel mixture in the combustion chamber portion of the cylinders 14 above the pistons 22 drives the pistons 22 downwardly and causes rotation of the crankshaft 16. Multi-cylinder engines provide multiple piston/cylinder arrangements arranged for sequential detonation of the fuel air mixture in a predetermined sequence for smooth engine operation. Generally, the greater number of cylinders, the smoother the engine will operate. Although the present invention is shown as a two-cylinder engine, the present invention is fully adaptable to engines having virtually any number of cylinders. The present invention is equally adaptable to spark ignited engines, diesel and other compression ignited engines, and radial engines.

The improvement of the present invention acts to vary the effective stroke length, i.e., the extent of piston travel, throughout the four strokes of the complete engine operational power cycle. The engine according to the present invention operates according to a modified Atkinson cycle wherein a full cycle of engine operation is defined by four separate strokes: the intake, or admission, stroke; the compression stroke; the expansion, or power, stroke; and the emission, or exhaust stroke. During the intake stroke in a given cylinder, the associated intake valves for the cylinder are opened while the piston is drawn downwardly by rotation of the crankshaft to thereby accept the fuel air mixture into the combustion chamber. During the compression stroke, the intake valves are closed while the piston reciprocates upwardly to compress the fuel air mixture in the combustion chamber to a predetermined degree, and at a predetermined time the compressed fuel-air mixture is detonated, e.g., a spark plug associated with the cylinder is fired, thus initiating the expansion stroke by driving the piston downwardly again through the cylinder as gases produced by the combustion expand. At the completion of the expansion stroke, the exhaust valves for the cylinder are opened as the piston begins to reciprocate again in the upward direction in the cylinder to execute the exhaust or emission stroke, during which the piston drives the waste combustion gases from the combustion chamber through the exhaust valves, to prepare to repeat the four strokes or cycles of the four-cycle engine. The so-called stroke length is defined as the distance the piston travels within the combustion chamber during each of the four strokes of the operational cycle. In a conventional internal combustion engine, the stroke length is fixed and does not vary throughout the four operational strokes of the engine operational power cycle.

By contrast, the present invention acts to provide a variable stroke length. Since the teeth of the second gear member 36 are formed on a inner surface thereof, the second gear member 36 rotates planetarily about the first gear member 32 in the same direction as the crankshaft 16 rotates. The gearing between the first and second gear members 32, 36 is selected to provide a 1:2 gear ratio, whereby the bearing member 48, and thereby its offset portion 44 and the maximum offset spacing 46, rotate through a one-half revolution for every single rotation of the crankshaft 16. The effect of this mechanical action is depicted in FIGS. 5-8 each of which illustrates a single stroke of the engine's operational power cycle.

Figure 5:
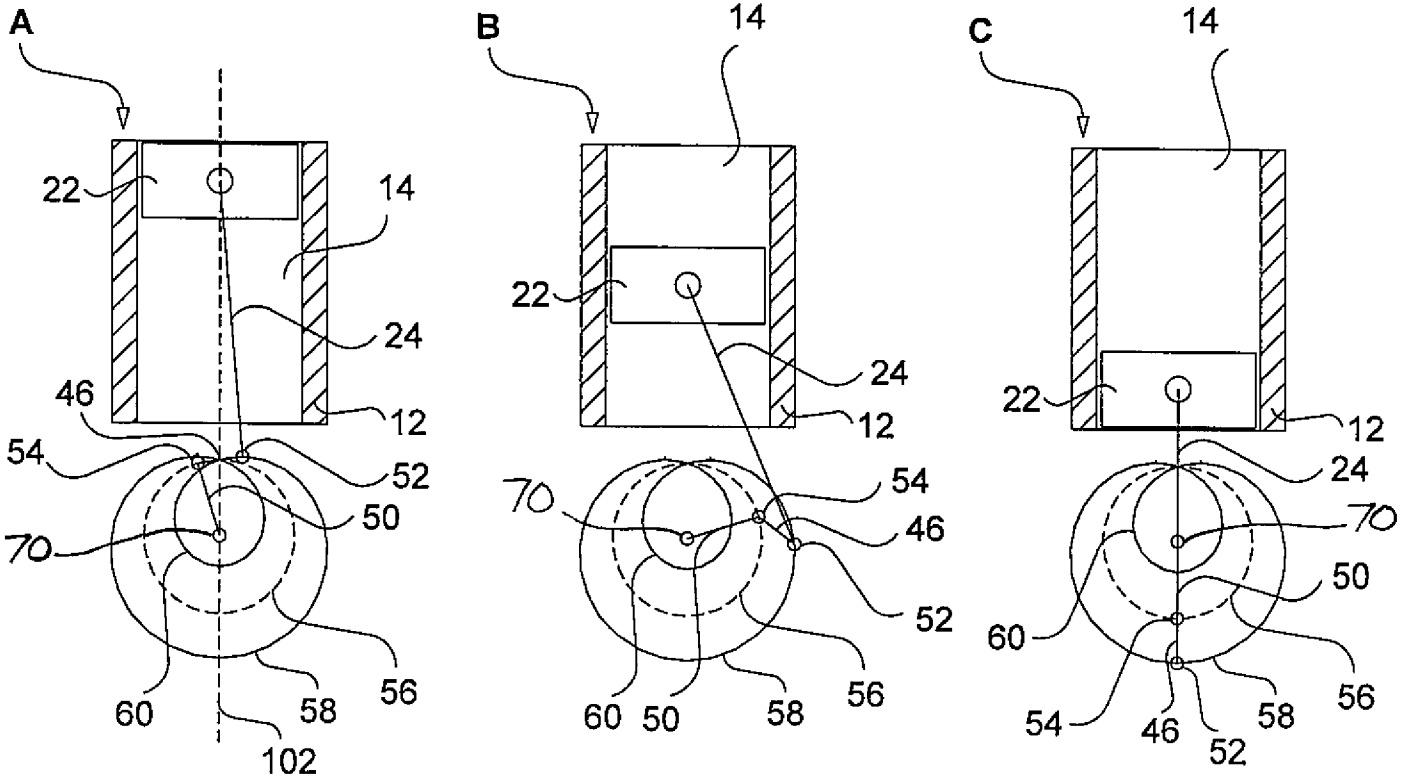
FIG. 5 is a diagrammatic view of the expansion stroke of an internal combustion engine equipped with a variable stroke mechanism according to a preferred embodiment of the present invention.
Figure 6:
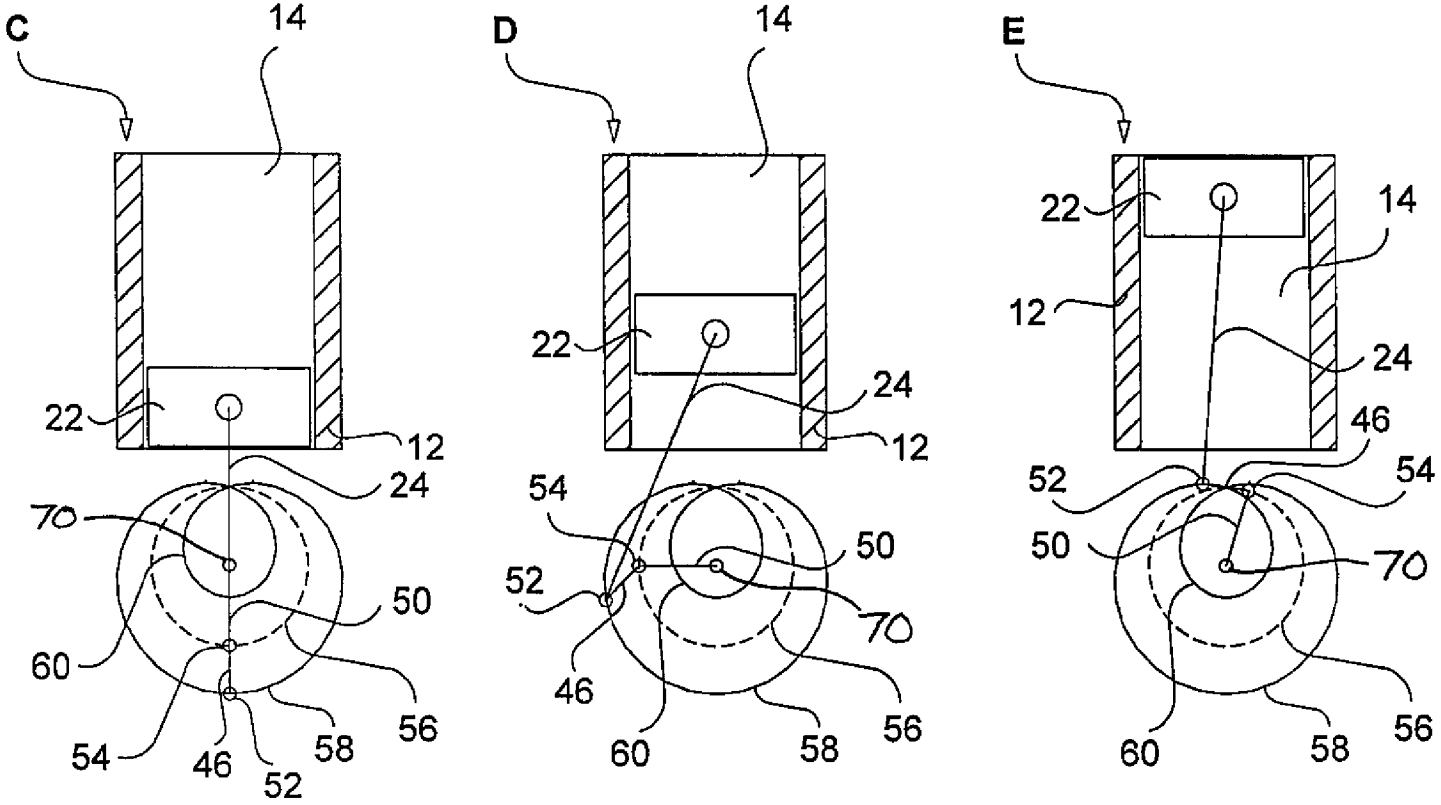
FIG. 6 is a diagrammatic view of the exhaust stroke of an internal combustion engine according to the embodiment of FIG. 5.
Figure 7:
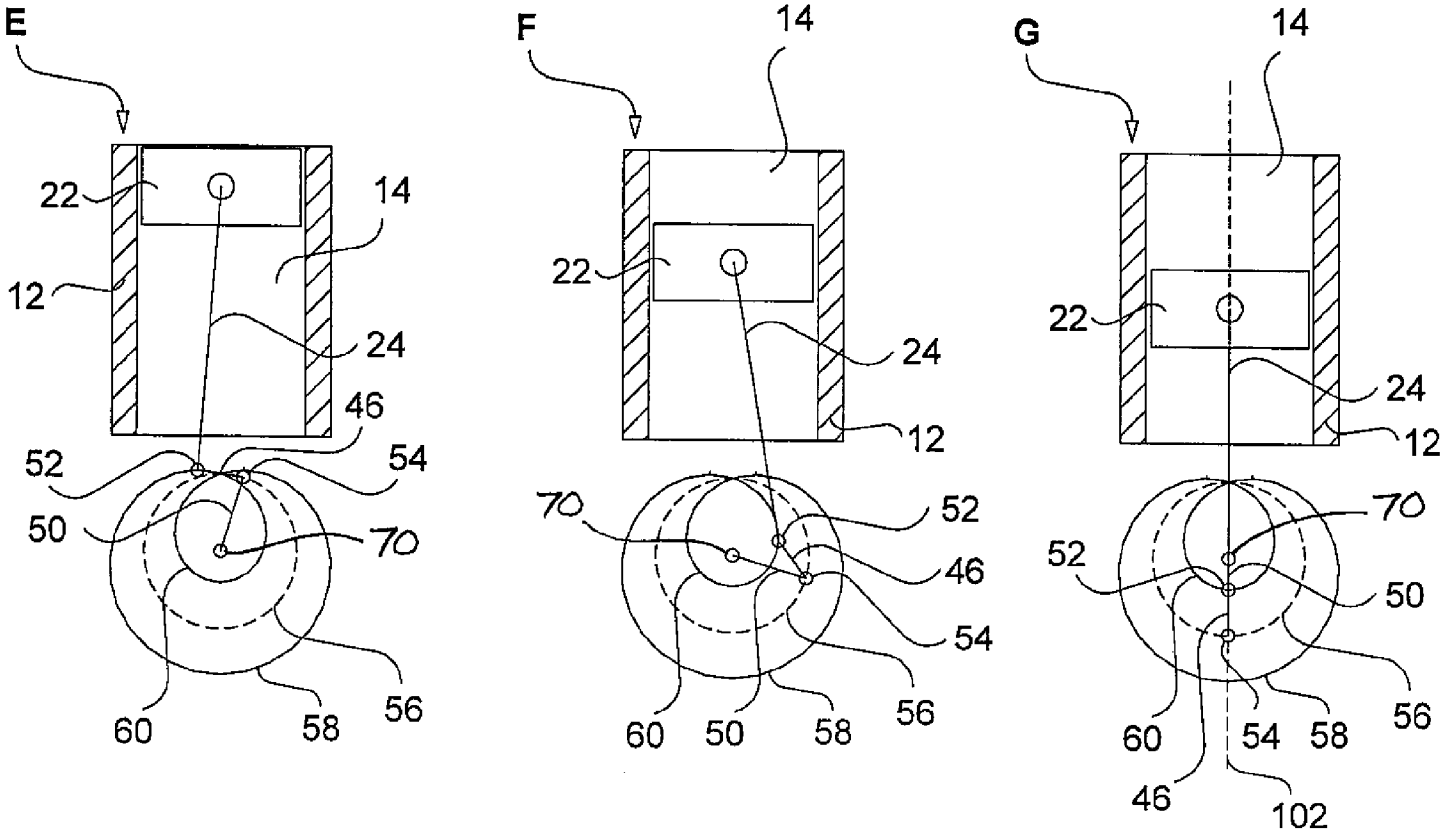
FIG. 7 is a diagrammatic view of the intake stroke of an internal combustion engine according to the embodiment of FIG. 5.
Figure 8:
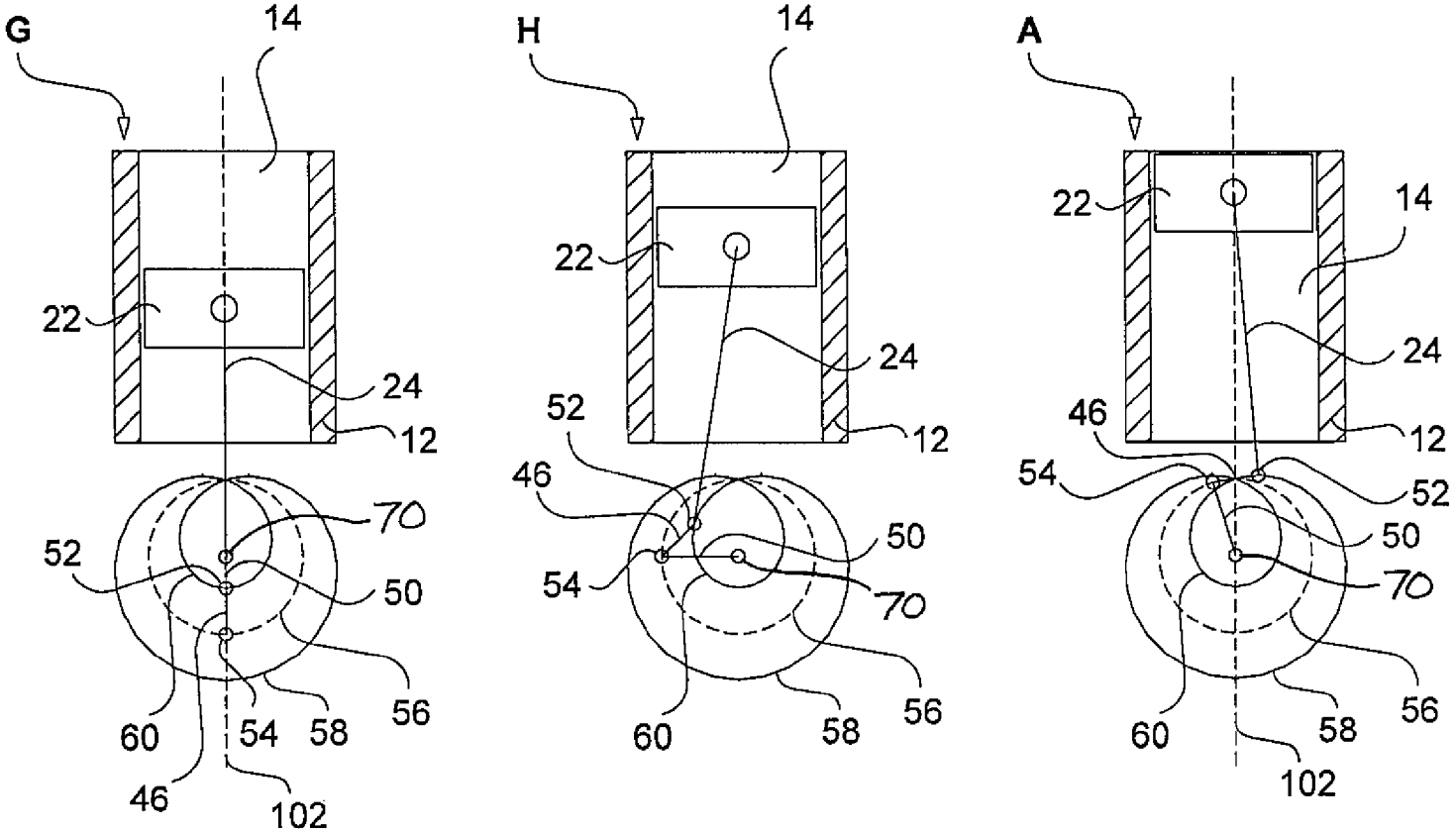
FIG. 8 is a diagrammatic view of the compression stroke of an internal combustion engine according to the embodiment of FIG. 5.

Turning now to FIGS. 5-8, the progression of the piston 22 and the associated geared mechanical assembly of the present invention connecting the piston 22 via the connecting rod 24 to the crankshaft 16 is schematically depicted in sequence through the expansion or power stroke, the exhaust stroke, the intake stroke, and the compression stroke. In each of FIGS. 5-8, the respective stroke is depicted at an initial starting position, an intermediate position, and a final position, designated by letters in sequence, with the final position of one stroke also constituting the initial position of the next following stroke under the same letter designation. Thus, the expansion or power stroke of the assembly is schematically depicted in FIG. 5, with the initial position of the piston 22 (commonly referred to as the "top dead center" position) illustrated at A, an intermediate driving position illustrated at B, and the final position illustrated at C. FIG. 6 depicts at C, D and E the initial, intermediate and final positions of the assembly in the exhaust stroke following the expansion/power stroke. FIG. 7 depicts at E, F and G the initial, intermediate and final positions of the assembly in the intake stroke following the exhaust stroke. FIG. 8 depicts at G, H and A the initial, intermediate and final positions of the piston 22 in the compression stroke following the intake stroke.

In FIGS. 5-8, the longitudinal centerline axis of the cylinder 14 of the engine block 12 along which the piston 22 reciprocates is indicated at 102, and the rotational axis of the crankshaft 16 is represented at 70. A junction point representing the connection between the bearing member 48 and the connecting rod 24 coinciding with the axis 74 is schematically indicated at 52, and a spaced apart junction point representing the connection between the bearing member 48 and the crankshaft 16 coinciding with the axis 72 is indicated at 54, with the spacing between the respective junctions 52, 54 representing the maximum offset spacing 46. The mechanical crank arm acting on the crankshaft 16 by means of the crankshaft offset is represented at 50 as extending between the crankshaft axis 70 and the junction 54 between the bearing member 48 and the crankshaft 16, and the variable cam arm produced by the maximum offset distance is represented at 46 as extending between the junction 52 between the connecting rod 24 and the bearing member 48 and the junction 54 between the bearing member 48 and the crank shaft 16. During rotation of the crankshaft 16 about its axis 70, the bearing member/crankshaft junction 54 traces a circular path 56 concentric about the crankshaft axis 70 as the assembly rotates. Owing to the spacing of the axes 72, 74 by the offset 46, the connecting rod/offset junction 52 traces two separate elliptical paths alternating between an outer elliptical path 58 and an inner elliptical path 60.

As will be understood, but for the presence of the mechanical gear set assembly of the present invention, the connecting rod 24 would otherwise be joined to the crankshaft 16 at 54, as in a conventional engine. Instead, as depicted in FIG. 5, the cam arm produced by the maximum offset 46 and the crank arm produced by the crankshaft offset 50 in the present mechanical gear set assembly together effectively increase the stroke length of the piston 22 after detonation as the expansion/power stroke progresses through the intermediate position of the piston 22 at B to the final position at C. Specifically, during the expansion stroke, the junction 52 between the bearing member 48 and the connecting rod 24 follows its outer eccentric path 58, whereby as the assembly progresses through position B and then to position C in FIG. 5, the crankshaft 16 has rotated through a one-half revolution during which the cam arm produced by the maximum offset 46 has acted to add to the crankshaft offset 50 to increase the effective stroke length such that the expansion stroke has been completed with the effective total crank length at its maximum. This increase of the effective stroke length acts to increase the work performed by the engine 10 in the expansion stroke. At this point, the exhaust stroke begins.

As illustrated by piston positions C, D, and E in FIG. 6, during the subsequent exhaust stroke the crankshaft/offset junction 54 passes the offset/connecting rod junction 52 as the junctions 52, 54 progress in their respective paths such that, at the conclusion of the exhaust stroke, the junctions 52, 54 have essentially reversed their relative positions from the beginning of the expansion stroke in FIG. 5A, whereby the total length of the piston stroke during the exhaust stroke is substantially the same as the piston stroke length of the expansion stroke. As a result, the piston fully evacuates combustion gases and by-products from the combustion chamber.

FIG. 7 illustrates the intake stroke for drawing in the fuel/air mixture by the piston 22, beginning at the final position E of the exhaust stroke of FIG. 6. During this portion of the operational cycle, the offset/connecting rod junction 52 traces its inner path 60, causing the effective stroke length to be progressively reduced as the assembly advances to and through position F until, at position G at the conclusion of the intake stroke, the effective stroke length has reduced to its minimum length by an amount equal to the crankshaft offset 50 less the maximum offset 46. From the initial position E to the final position G in FIG. 7, the crankshaft rotates through a one-half revolution. As a result of the reduction in the effective stroke length during the intake stroke, the amount of work that the engine must perform in retracting the piston to admit the fuel/air mixture into the combustion chamber 14 is correspondingly reduced achieving a commensurate reduction in fuel usage. The speed at which the piston 22 moves downwardly during the intake stroke is commensurately slower than during the preceding expansion and exhaust strokes.

FIG. 8 depicts the subsequent compression stroke beginning at position G at the conclusion of the intake stroke. As the assembly progresses through intermediate position H to return to starting position A to begin another expansion stroke, the offset/connecting rod junction 52 completes its movement through its inner path 60 and once again moves to its outer path 58.

Figure 9:
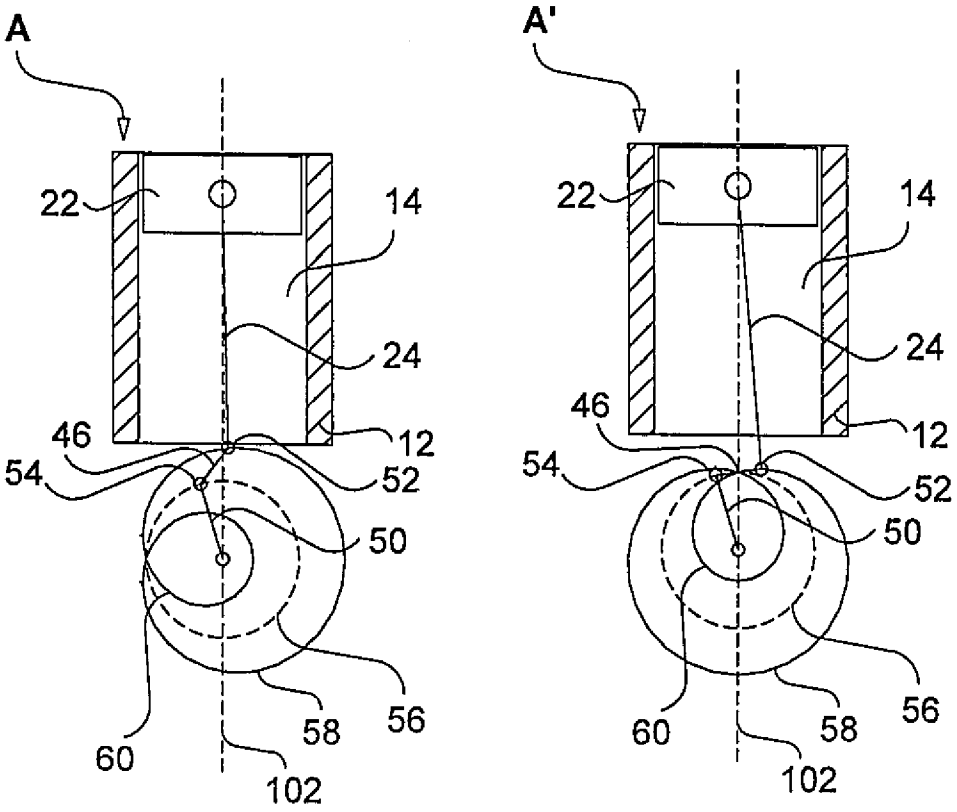
FIG. 9 is a diagrammatic view comparing the embodiment of the present invention shown in FIGS. 5-8 against the invention of U.S. Pat. No. 5,927,236.

The present invention provides several advancements over the invention of U.S. Pat. No. 5,927,236. According to one aspect of the present invention, the gear set 30 is arranged such that the connection between the bearing member 48 of the second gear member 36 and the connecting rod 24 orient the outer and inner elliptical paths 58, 60 traced by the junction point 52 (i.e., the axis 74 for the connecting rod 24) to intersect at a point at or closely adjacent to the combustion chamber axis 102 which thereby causes the mechanical crank arm and the cam arm to cooperatively produce a positive torque on the crankshaft at the top dead center position of the piston. More specifically, FIGS. 5-8 depict an embodiment of the present invention wherein the intersection of the elliptical outer and inner paths 58, 60 coincides with the axis 102 of the cylinder/combustion chamber. By contrast, as depicted in FIG. 9, in the preferred embodiment illustrated and described in U.S. Pat. No. 5,927,236, the intersection of the outer and inner paths 58, 60 is oriented ninety degrees (90°) in advance of the cylinder axis 102 as viewed in relation to the rotational direction of the crankshaft.

Figure 11:
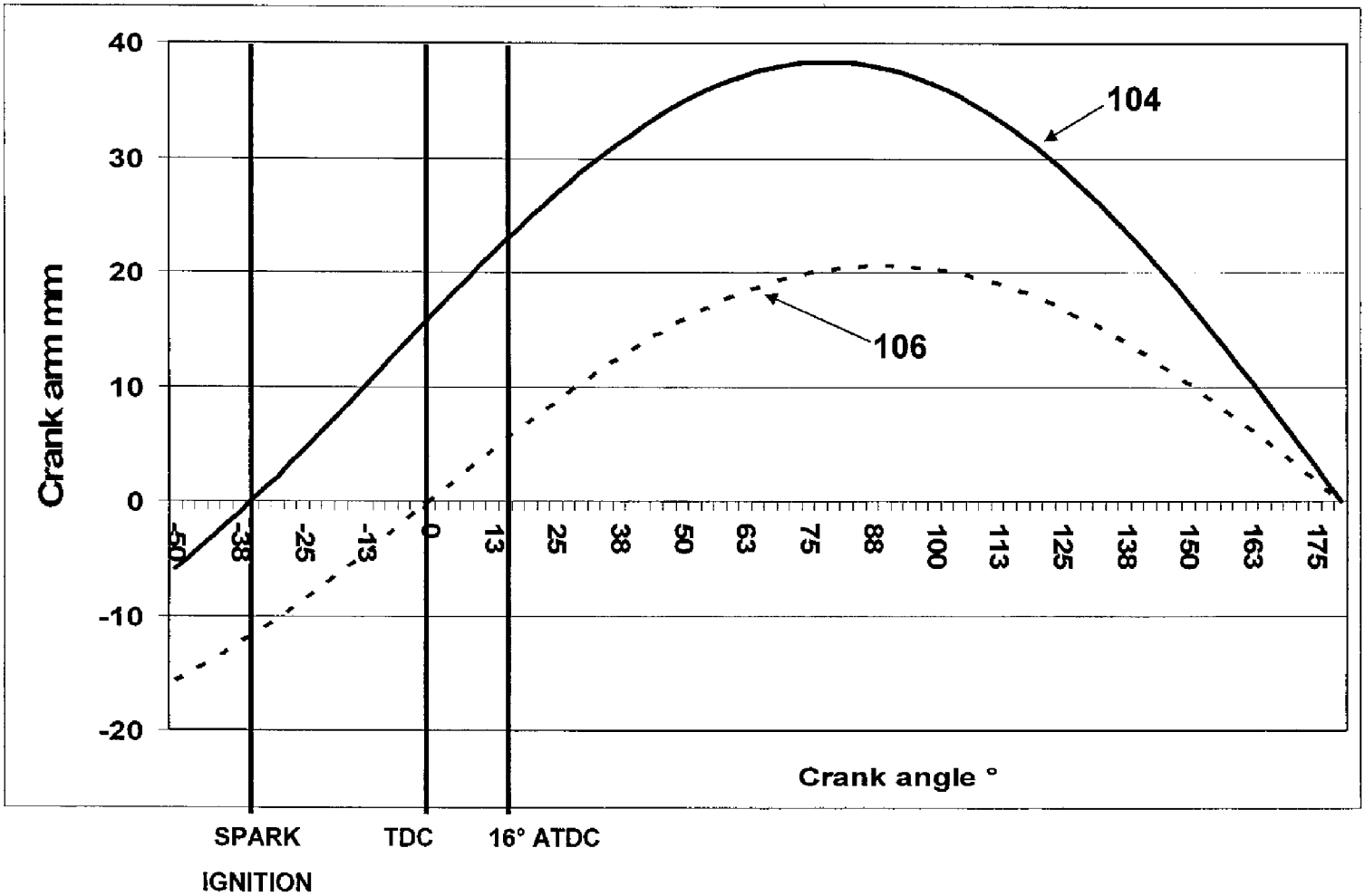
FIG. 11 is a graph depicting comparative torque curves for an internal combustion engine equipped with a variable stroke mechanism according to the present invention and for a conventional four-stroke internal combustion engine.

Advantageously, this modified orientation of the mechanical arrangement in the present invention produces an enlarged mechanical crank arm acting on the piston at its top dead center position over the preferred embodiment of U.S. Pat. No. 5,927,236, as is seen comparatively in FIG. 9, and commensurately improves the mechanical crank arm and attendant crankshaft torque over the full range of the four cycles of the engine. The enhancement of the crank arm is particularly remarkable as compared to a conventional engine without any variable stroke arrangement, as is illustrated in the graph of FIG. 11. In FIG. 11, curve 104 plots the mechanical crank arm, measured in millimeters, produced in a 1000 cc displacement four cylinder engine embodying the present invention against the crank angle of the engine over its four cycles or strokes, and curve 106 comparatively plots the mechanical crank arm produced in a conventional 1000 cc displacement four cylinder engine wherein the piston connecting rods are connected directly to the crankshaft without any mechanical or other arrangement to vary the piston stroke.

As the curve 106 illustrates, conventional engines suffer a significant amount of negative torque on the crankshaft during the compression stroke when approaching the expansion/power stroke, typically requiring that the combustion spark be fired as much as thirty five degrees (35°) in advance of the top dead center position. In such an engine, the piston must perform negative work to overcome the negative torque, which continues to prevail until a torque value of zero is reached at the top dead center (TDC), and no significant amount of positive torque is produced until about sixteen degrees (16°) after the top dead center position (ATDC). This is a primary reason that convention engines are generally incapable of idling at engine speeds lower than about 800 RPM. By contrast, with the arrangement of the present invention orienting the intersection of the outer and inner elliptical paths 58, 60 traced by the junction point 52 (i.e., the axis 74 for the connecting rod 24) at or closely adjacent to the combustion chamber axis 102, the increased crank arm produces positive torque increasing from thirty five degrees) (35° in advance of the top dead center position to the top dead center position, and at sixteen degrees (16°) after the top dead center position, the torque produced in the present engine is more than double that of the conventional engine.

Figure 10:
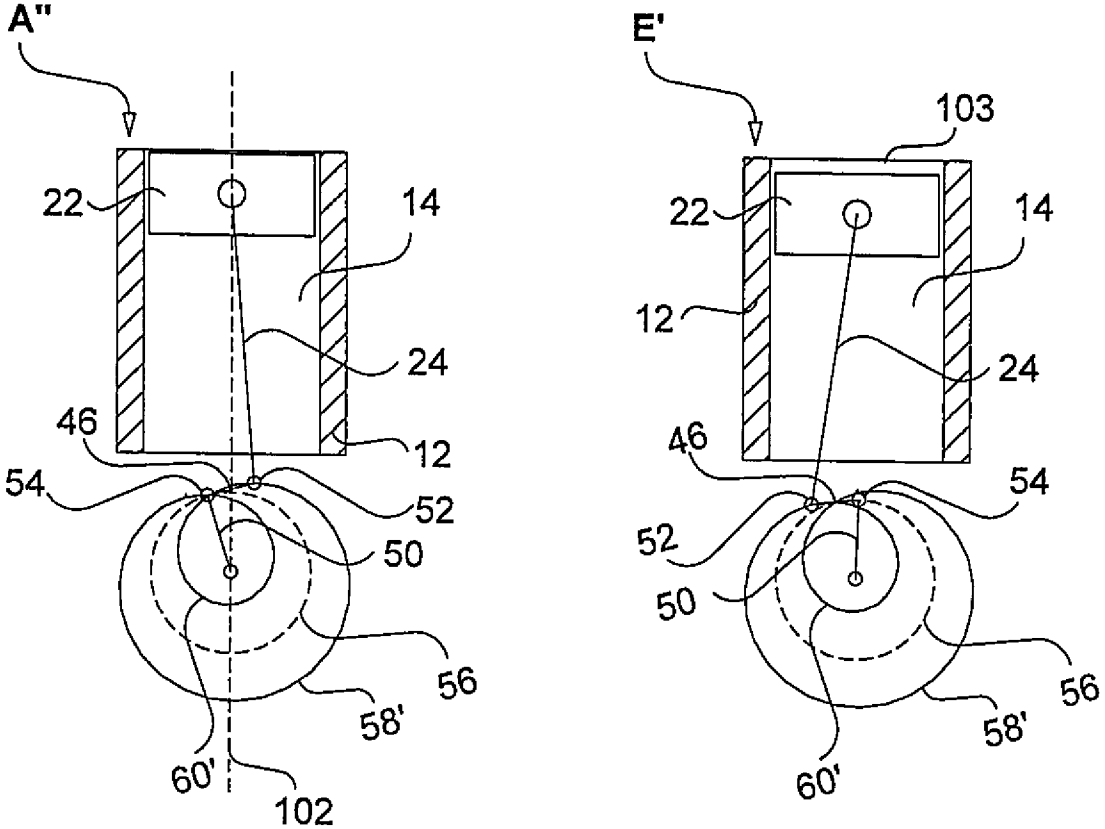
FIG. 10 is a diagrammatic view similar to FIGS. 5-8, depicting an alternative embodiment of a variable stroke mechanism for an internal combustion engine according to the present invention.

As depicted in FIG. 10, alternative embodiments of the present invention are possible wherein the intersection of the elliptical outer and inner paths 58, 60 is within about twenty five degrees (25°) of the combustion chamber axis. Specifically, FIG. 10 depicts an alternative embodiment wherein the mechanical arrangement of the present invention is configured to orient the intersection of the elliptical outer and inner paths 58, 60 at a point spaced a predetermined number of degrees less than or equal to approximately twenty five degrees (25°) in advance of the combustion chamber axis, as viewed in the direction of rotation of the crankshaft. Position A' in FIG. 10 depicts the piston and other associated mechanical components of the present invention at the initial outset of the expansion stroke, i.e., the top dead center position, and it can be seen that the arrangement still produces a significantly enlarged mechanical crank arm acting on the piston at such position as compared to U.S. Pat. No. 5,927,236. Furthermore, an additional advantage achieved by this arrangement is that the position of the piston at the conclusion of the exhaust stroke and at the beginning of the intake stroke is caused to be at a predetermined spacing below the top dead center position, as represented by position E' in FIG. 10. The selective orientation of the mechanical arrangement in this manner permits the combustion chamber to retain a predetermined volume of exhaust gases when beginning the intake stroke which in turn contributes to the reduction of harmful emissions from the engine.

Figure 12:
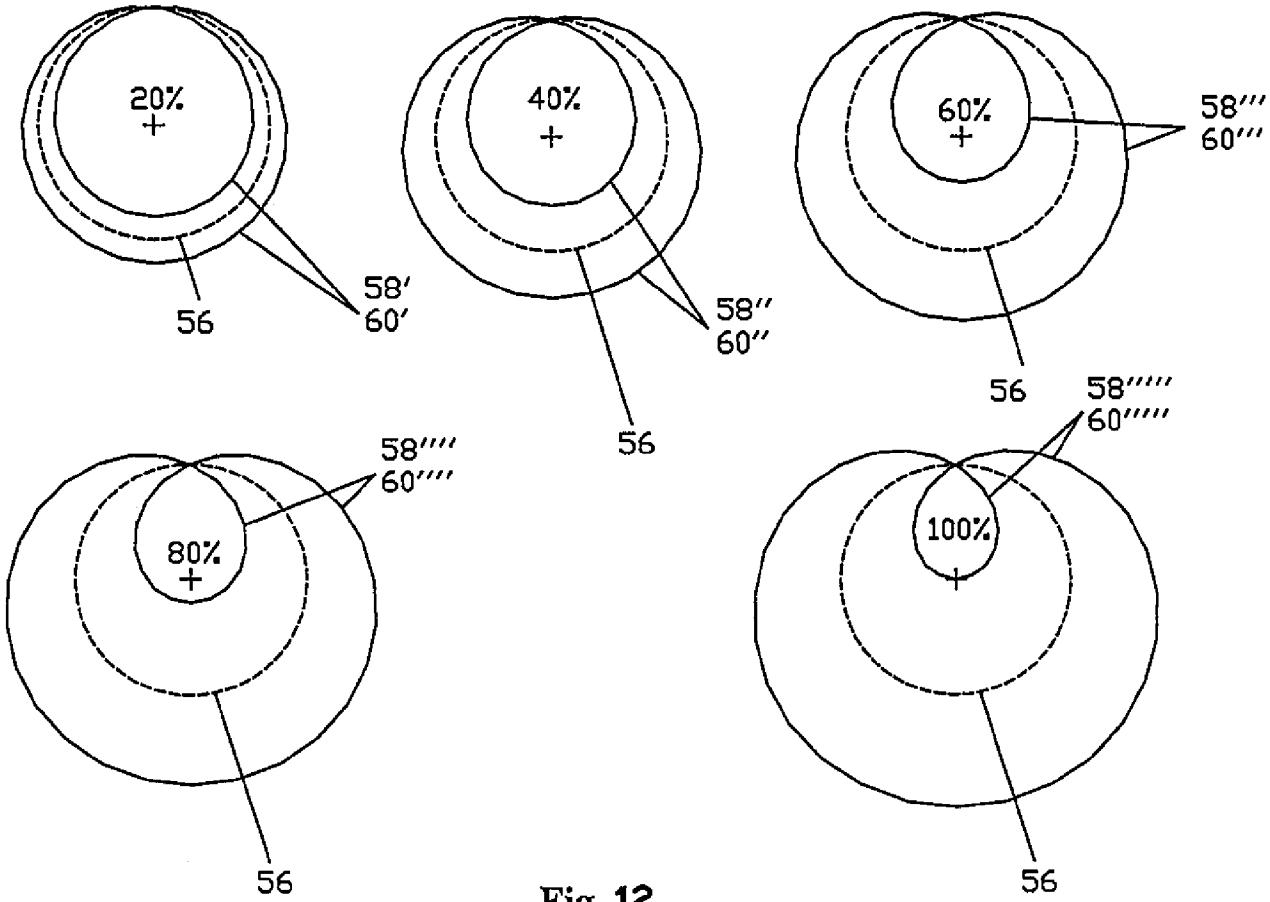
FIG. 12 schematically depicts the differing paths traced by the cam arm and the crank arm in differing embodiments of the variable stroke mechanism of the present invention utilizing respectively differing selective variations in ratio of the length of the cam arm to the length of the crank arm.

It has also been discovered that the selective variation of the ratio of the length of the cam arm 46 to the length of the crank arm 50 enables the volumetric capacity in the combustion chamber at the conclusion of the intake stroke and the related functional variable of the compression to expansion ratio to be selectively varied. For example, it is contemplated that the cam arm length may vary from at least approximately 20% of the crank arm length up to approximately 100% of the crank arm length. Such variations may be accomplished by varying the dimensions and eccentric relationship of the outer and inner bearing surfaces 40, 42 of the bearing member 48 to achiever differing selected crank arms 50 and differing selected cam arms 46. FIG. 12, schematically depicts the relative changes and relative differences produced in the configuration (sizes and shapes) in the outer and inner elliptical paths 58, 60 traced by the junction point 52 (i.e., the axis 74 for the connecting rod 24) when selectively varying the cam arm to crank arm ratio in increments of twenty percent (20%). The chart of FIG. 13 compiles comparative data for the attendant variables affected by such changes. In particular, the data compiled in this chart assumes a 1000 cc displacement engine, i.e., with a fixed 1000 cc admission cycle, and with a fixed compression ratio of 10:1 for an engine employing spark ignited combustion or a fixed 15:1 compression ratio for an engine employing compression to ignite combustion. Overall, the chart illustrates that increases in the cam arm to crank arm ratio achieve a substantial advantage over otherwise comparable 1000 cc displacement conventional engines in fuel consumption (miles traveled per gallon) and in torque. For example, with a cam arm to crank arm ratio of 70% in such a 1000 cc engine, the engine achieves an expansion capacity of 1739 cc, and an expansion ratio of 16.7:1 is achieved with a compression ratio of 10:1. In effect, this configuration of a 1000 cc engine according to the present invention will produce the torque and horsepower output of a 1739 cc engine but will consume only the same amount of fuel as a conventional 1000 cc engine.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In an internal combustion engine comprising:

an engine block defiling a plurality of cylindrical combustion chambers each defining a chamber axis, a crankshaft mounted to the engine block for rotation about a crankshaft axis extending transversely to the combustion chambers, a piston disposed within each combustion chamber for reciprocation along the chamber axis thereof, the internal combustion engine being operable according to a four stroke cycle wherein the piston reciprocates within the combustion chamber through an intake stroke moving in a first direction, a compression stroke moving in a second direction, an expansion stroke moving in the first direction, and an exhaust stroke moving in the second direction, wherein the position of the piston at the conclusion of the compression stroke and at the beginning of the expansion stroke is defined as top dead center and the position of the piston at the end of the expansion stroke and at the beginning of the exhaust stroke is defined as bottom dead center, a connecting rod pivotably mounted to each piston, a mechanical assembly connecting each connecting rod rotatably to the crankshaft for translating the reciprocating motion of the piston into rotational motion of the crankshaft, the mechanical assembly comprising:

a first gear member non-rotatably mounted to the engine block, the first gear member including:

a cylindrical body with a pinion gear portion having gear teeth formed about a radially outward surface of the cylindrical body, and a second gear member meshingly engaged with the first gear member, the second gear member including:

an annular body with a crown gear portion having gear teeth formed about a radially inward surface of the annular body, the cylindrical body of the first gear member extending into the annular body with the gear teeth of the pinion gear portion in meshing engagement with the gear teeth of the crown gear portion, and a bearing portion projecting outwardly from the crown gear portion and having a first bearing surface formed on an outer surface of the bearing portion and a second bearing surface formed on an inner surface of the bearing portion, the connecting rod being mounted about the first bearing surface and the crankshaft being mounted within the second bearing surface, for rotation of the second gear member with the crankshaft, with the connecting rod rotating on the first bearing surface and the second bearing surface rotating on the crankshaft, the pinion gear portion of the first gear member and the crown gear portion of the second gear member having a gear ratio of 2:1 for causing the second gear member to rotate once for every two rotations of the crankshaft, the second bearing surface being offset from the crankshaft axis to move in a circular path about the crankshaft axis for imposing a mechanical crank arm on the crankshaft which is uniform throughout the four stroke cycle of the engine, the first and second bearing surfaces being spaced from one another by an offset distance causing the first bearing surface to move alternatingly in inner and outer elliptical paths about the crankshaft for imposing a mechanical cam arm on the crankshaft which varies over the four stroke cycle of the engine, the rotation of the second gear member with the crankshaft imposing a combined effective crank arm on the crankshaft equivalent to the vectorial sum of the crank arm and the cam arm which constantly varies over the four stroke cycle of the engine causing the length of the reciprocation of the piston to vary throughout the four stroke cycle of the engine, the improvement wherein:

the first and second bearing surfaces of the second gear member are selectively configured and dimensioned such that:

the cam arm is of a length greater than 20% and up to 100% of the length of the crank arm, at top dead center, the cam arm is oriented at generally substantially 90 degrees to the crank arm, at top dead center, the crank arm is oriented at an angle in advance of the chamber axis, the crank arm and the cam arm act to cooperatively produce a positive torque on the crankshaft beginning before the end of the compression stroke up to about twenty) (20°) in advance of, and continuing through, the top dead center position of the piston into and during the expansion stroke, at the completion of the expansion stroke, each of the crank arm and the cam arm extend in linear alignment with the chamber axis with the cam arm extending outwardly from the crank arm, thereby forming the longest combined effective crank arm during the four stroke cycle of the engine, at the completion of the intake stroke, each of the crank arm and the cam arm extend in linear alignment with the chamber axis with the camp arm extending inwardly in overlapping relation to the crank arm, thereby forming the shortest effective crank arm during the four stroke cycle of the engine, the intake and compression strokes in the four stroke cycle of the internal combustion engine are shorter than the expansion and exhaust strokes, and a substantially uniform compression ratio is maintained throughout the four stroke cycle of the internal combustion engine.

* * * * *

UNITED STATES PATENT AND TRADEMARK OFFICE

CERTIFICATE OF CORRECTION

PATENT NO. : 8,967,097 B2
APPLICATION NO. : 13/109505
DATED : March 3, 2015
INVENTOR(S) : Luis Marino Gonzales Perez et al.

It is certified that error appears in the above-identified patent and that said Letters Patent is hereby corrected as shown below:

In the Specification,

Column 1, Line 58 "during the exhaust stoke following each expansion stoke and" should read --during the exhaust stroke following each expansion stroke and--.

Column 2, Line 25 "engine" should read --engine.--.

Column 5, Line 41 "divide the engine 10 into two minor-imaged halves, with the" should read --divide the engine 10 into two mirror-imaged halves, with the--.

Column 10, Line 19 "torque increasing from thirty five degrees) (35° in advance of" should read --torque increasing from thirty five degrees (35°) in advance of--.

In the Claims,

Column 11, Claim 1, Line 42 "an engine block defiling a plurality of cylindrical combus-" should read --an engine block defining a plurality of cylindrical combus- --.

Column 12, Claim 1, Line 55 "substantially 90 degrees to the crank arm," should read --90 degrees to the crank arm--.

Column 12, Claim 1, Line 61 "twenty) (20°) in advance of, and continuing through," should read --twenty degrees (20°) in advance of, and continuing through,--.

Column 13, Claim 1, Line 5 "the chamber axis with the camp arm extending" should read --the chamber axis with the cam arm extending--.

Signed and Sealed this
Twenty-second Day of September, 2015

Michelle K. Lee

Michelle K. Lee
*Director of the United States Patent and Trademark Office*